US007464670B2

(12) United States Patent
Hermamdez et al.

(10) Patent No.: US 7,464,670 B2
(45) Date of Patent: Dec. 16, 2008

(54) SYSTEM FOR CLEANING, INSPECTION AND TOOLING DELIVERY IN THE SECONDARY SIDE OF A STEAM GENERATOR

(75) Inventors: Eric Leon Hermamdez, Lynchburg, VA (US); George Vick Owen, Forest, VA (US); Kert David Klahn, Forest, VA (US)

(73) Assignee: Framatome ANP, Inc., Lynchburg, VA (US)

( * ) Notice: Subject to any disclaimer, the term of this patent is extended or adjusted under 35 U.S.C. 154(b) by 0 days.

(21) Appl. No.: 11/493,265

(22) Filed: Jul. 26, 2006

(65) Prior Publication Data

US 2008/0022948 A1 Jan. 31, 2008

(51) Int. Cl.
*F22B 37/48* (2006.01)

(52) U.S. Cl. ..... 122/379; 239/750

(58) Field of Classification Search ..... 122/379, 122/390; 15/316.1, 317, 318; 239/722–753
See application file for complete search history.

(56) References Cited

U.S. PATENT DOCUMENTS 4,848,278 A * 7/1989 Theiss ..... 122/383
5,036,871 A * 8/1991 Ruggieri et al. ..... 134/167 R
5,065,703 A * 11/1991 Lee ..... 122/382
5,172,653 A * 12/1992 Vadakin ..... 122/392
5,348,234 A * 9/1994 v.d. Woude ..... 239/753
5,494,004 A * 2/1996 Hunter, Jr. ..... 122/395
5,564,371 A * 10/1996 Ashton et al. ..... 122/392
5,575,328 A * 11/1996 Hyp ..... 165/11.2
5,813,370 A * 9/1998 Owen et al. ..... 122/382
6,065,202 A * 5/2000 Ware et al. ..... 29/434
6,513,462 B1 * 2/2003 Shiraishi et al. ..... 122/382
6,672,257 B1 * 1/2004 Ashton et al. ..... 122/379
7,162,981 B2 * 1/2007 Hernandez ..... 122/379

* cited by examiner

*Primary Examiner*—Gregory A Wilson
(74) *Attorney, Agent, or Firm*—Vytas R. Matas

(57) ABSTRACT

A system for delivering tooling around the annulus of a steam generator without damaging any part of the steam generator is provided where the tooling delivery device travels between the tube bundle and the vessel shell and delivers tooling for cleaning, inspection, retrieval and repair. The device has various types of locomotion system including treads, rollers, magnets and vacuum. The cleaning device has multiple high pressure nozzles that rotate 180 degrees about a horizontal axis and 360 degrees about a vertical axis enabling the device to sweep multiple lanes of tubes simultaneously and also clean the front and back of the annulus floor and tube sheet.

7 Claims, 9 Drawing Sheets

SYSTEM FOR CLEANING, INSPECTION AND TOOLING DELIVERY IN THE SECONDARY SIDE OF A STEAM GENERATOR

BACKGROUND OF THE INVENTION

1. Field of the Invention

The present invention generally relates to steam generator sludge removal systems and more particularly to such systems for use in the secondary side of the steam generator.

2. Description of the Prior Art

Buildup of sediment or sludge on the secondary face of the tube is sheet in a boiler or steam generator has been proven to contribute to degradation of the tube material. It is a common practice to lance the tube sheet, and tube support plates with high pressure water to wash the sludge from between the tubes to a suction pickup where it can be removed from the steam generator. Most re-circulating steam generators have a wide lane that separates the hot leg tubes from the cold leg tubes. A wand that contains high pressure nozzles is inserted into this lane and the sludge forced out to the area between the steam generator shell and the tube bundle, called the annulus. From the annulus the sludge is easily washed to a suction pickup and removed from the steam generator.

In some recirculating steam generators and in Once Through Steam Generators (OTSG's) the geometry of the tube bundle does not permit lancing to be efficiently performed from a lane in the tube bundle. These generators must be lanced either totally or partially from the annulus.

The current method of lancing and inspection from the annulus uses a device that is pulled around the tube bundle with cables. These cables have frequently damaged tubes by abrasion-around the outside of the tube bundle.

BRIEF SUMMARY OF THE INVENTION

It is the purpose of this invention to provide a system for delivering tooling around the annulus of a steam generator without damaging any part of the steam generator. The tooling delivery device travels between the tube bundle and the vessel shell, or the bundle shroud and the vessel shell and delivers tooling for cleaning, inspection, retrieval and repair. The device has various types of locomotion systems including treads, rollers, magnets and vacuum.

One type of tooling is a cleaning device, referred to as a turret, consisting of multiple high pressure nozzles that rotate 180 degrees about a horizontal axis enabling the device to sweep multiple lanes of tubes simultaneously. The device also rotates 360 degrees about a vertical axis allowing it to clean the front and back of the annulus floor and tube sheets.

In view of the foregoing it will be seen that one aspect of the present invention is to provide a locomotion device for various types of tooling in a steam generator for inspection, cleaning or repair purposes.

Another aspect is to provide various types of locomotion devices for various tooling including rubber tracks, rollers, magnets and vacuum devices.

Yet another aspect is to provide a steam generator tube cleaning device which is able to travel around the entire vessel and sweep the tube sheet or support plate with high pressure water jets.

Still yet another aspect is to provide a tube cleaning device having an on board camera and lights for inspecting the interior of the vessel and for aligning the water jets between the heat exchanger tube lanes.

These and other aspects of the present invention will be more fully understood after a review of the following description of the preferred embodiment when considered along with the accompanying drawings.

DESCRIPTION OF THE PREFERRED EMBODIMENT

Figure 1:
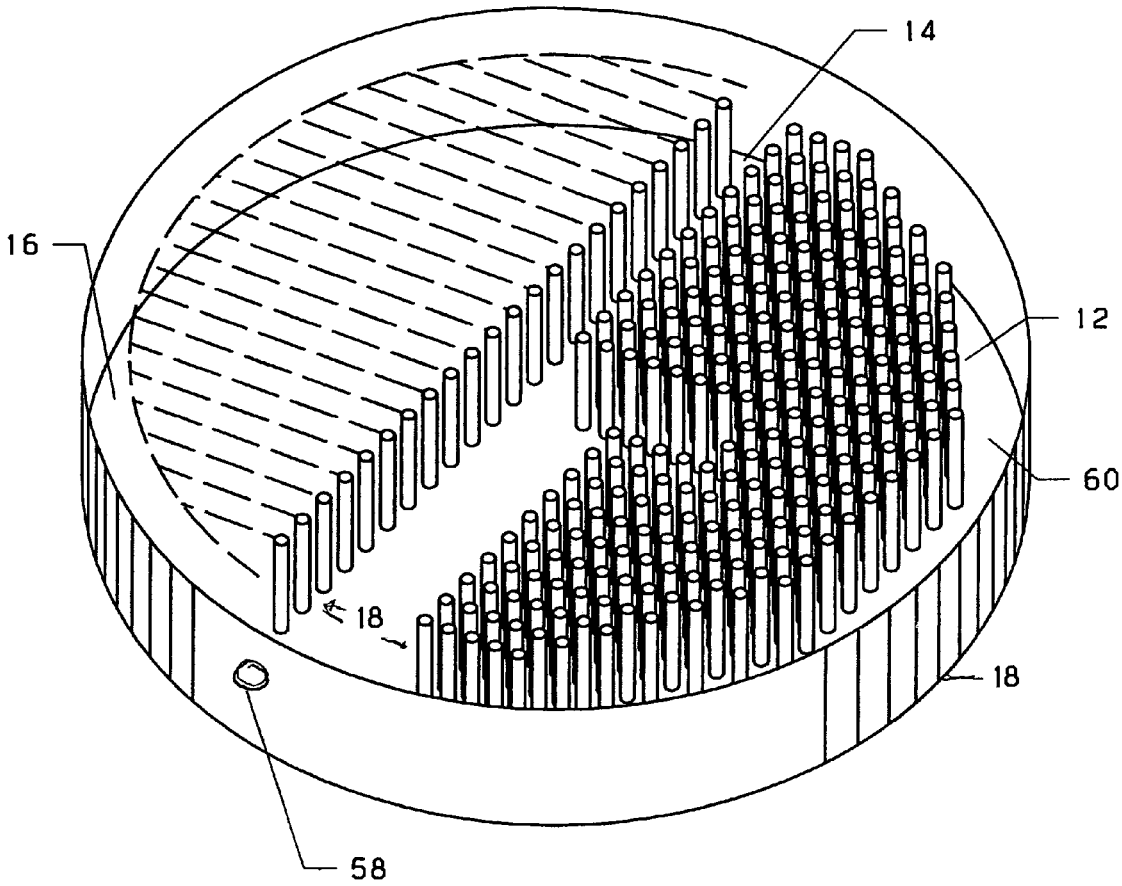
FIG 1 PRIOR ART
FIG. 1 is a schematic perspective view illustrating the tube bundle of a typical steam generator.

The locomotion and tooling system of the present invention is designed to simplify maintenance on the secondary side of steam generators. As shown in FIG. 1, a typical steam generator secondary-side assembly comprises a pair of generally semicircular bundles (10) of vertically extending steam tubes (12) separated by a central tube lane (14). An annular space (16) separates the tube bundles (10) from the steam generator shell (18).

In order to provide more efficient transfer of heat between the primary and secondary generator systems most newer steam generators employ the triangular-pitch tube configuration which provides increased tube density. As a consequence, the gaps between the tubes (12) are greatly reduced, and there are no well defined access channels between the tubes (12). This configuration thus makes maintenance of the steam generator more difficult Conventional sludge-lancing equipment located in the tube lane are no longer effective at dislodging sludge centrally located in the tube bundle. Thus a tube cleaning system located in the annulus (16) providing a high water pressure localized jet stream is needed to dislodge the sludge from the tubes (12). The dislodged sludge is removed by known suction devices which may be located at the central tube lane (14) or along the annulus.

Referring now to FIGS. 2-6 a tube cleaning system (20) is shown comprising a cleaning turret assembly (22) having a top mounted skid assembly (24) with both assemblies mounted onto a locomotion assembly (26) called a crawler.

Figure 3:
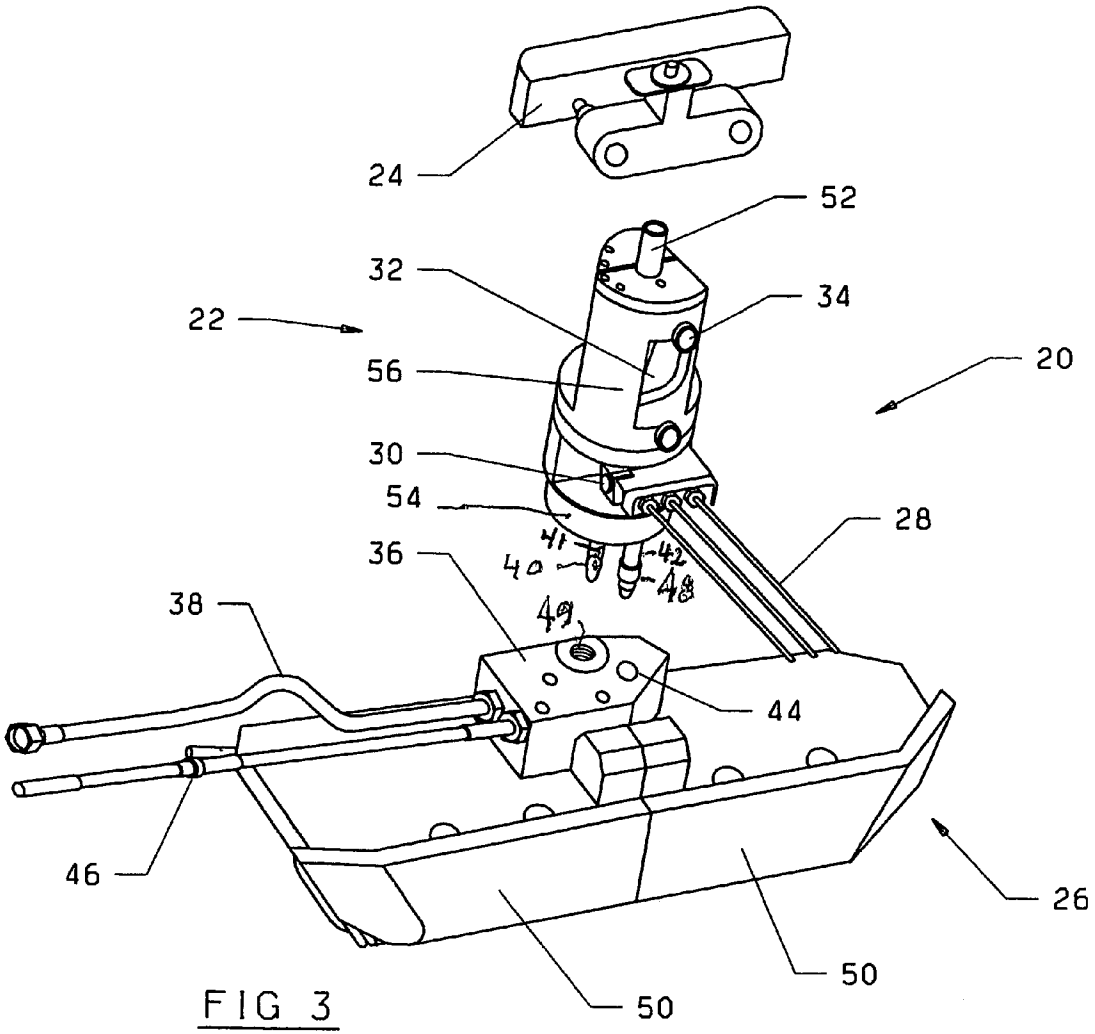
FIG. 3 shows the three main elements of the FIG. 2 system separated from each other.

With particular reference to FIG. 3 it will be seen that the turret assembly (22) has a series of high pressure water nozzles (28) which rotate about a horizontal axis (30) to provide a strong water cleaning jet stream simultaneously to three adjoining tube lanes. The turret assembly (22) also has a camera (32) and a light source (34) to sufficiently illuminate the tubes to allow viewing at a remote location. This facilitates the location of the cleaning system (20) in the annulus (16) so as to align the nozzles (28) with the tube lanes.

The crawler (26) has a high pressure swivel/locking mechanism (36) with a water supply line (38) leading thereto for powering the high water pressure nozzles (28) through a water inlet peg (40) when the turret assembly (22) is mounted to the mechanism (36). This mounting comprises the insertion of a locking pin (42) into a chamber (44) where a spring loaded wedge (not shown) which fits into a grove (48) on the pin (42).

Figure 4:
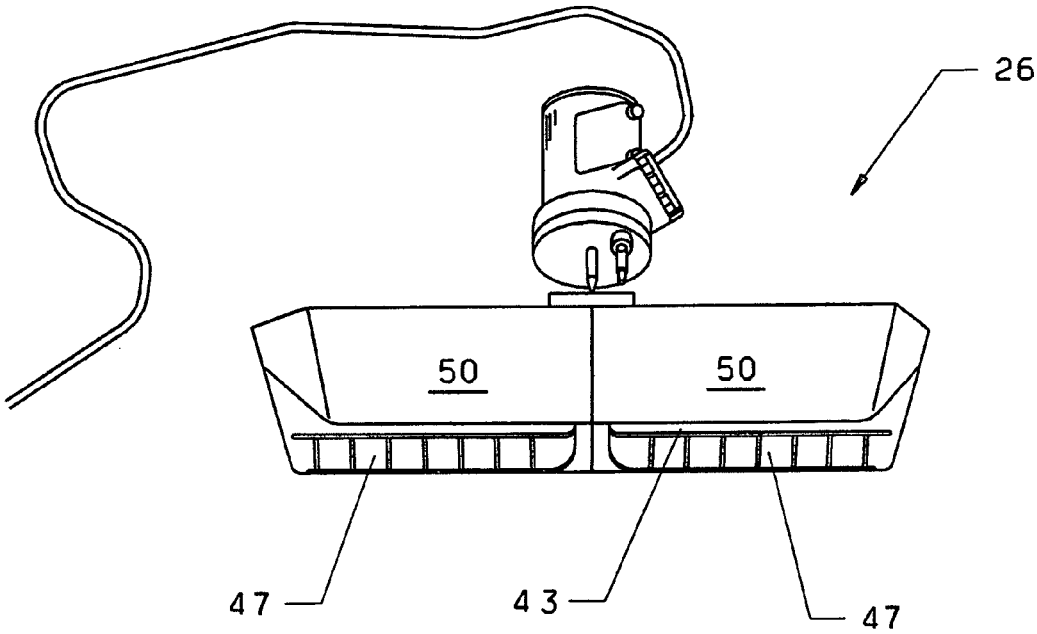
FIG. 4 is a bottom view of the locomotion device of FIG. 3 showing the rubber tracks.

This lock is released by an unlock cable (46) connected to the wedge member which can pull the member from the grove (48). The peg (40) has A series of openings (41) and sealably fits into a hole (49) on the member (36) which is in communication with the water line (38) to feed water to the nozzles (28). As best seen in FIG. 4, the crawler (26) is propelled by two bottom mounted tracks (43) using re-circulating rubber treads (47). Soft plastic bumpers (50) are mounted to the crawler side to prevent contact of metal components with the steam generator tubing. The bumpers (50) are contoured to confirm to the diameter of the tube bundle (10) when the system (20) is located in the annulus (16) of the steam generator. The rubber tread mount and drive is a known assembly which is a purchased component.

Figure 2:
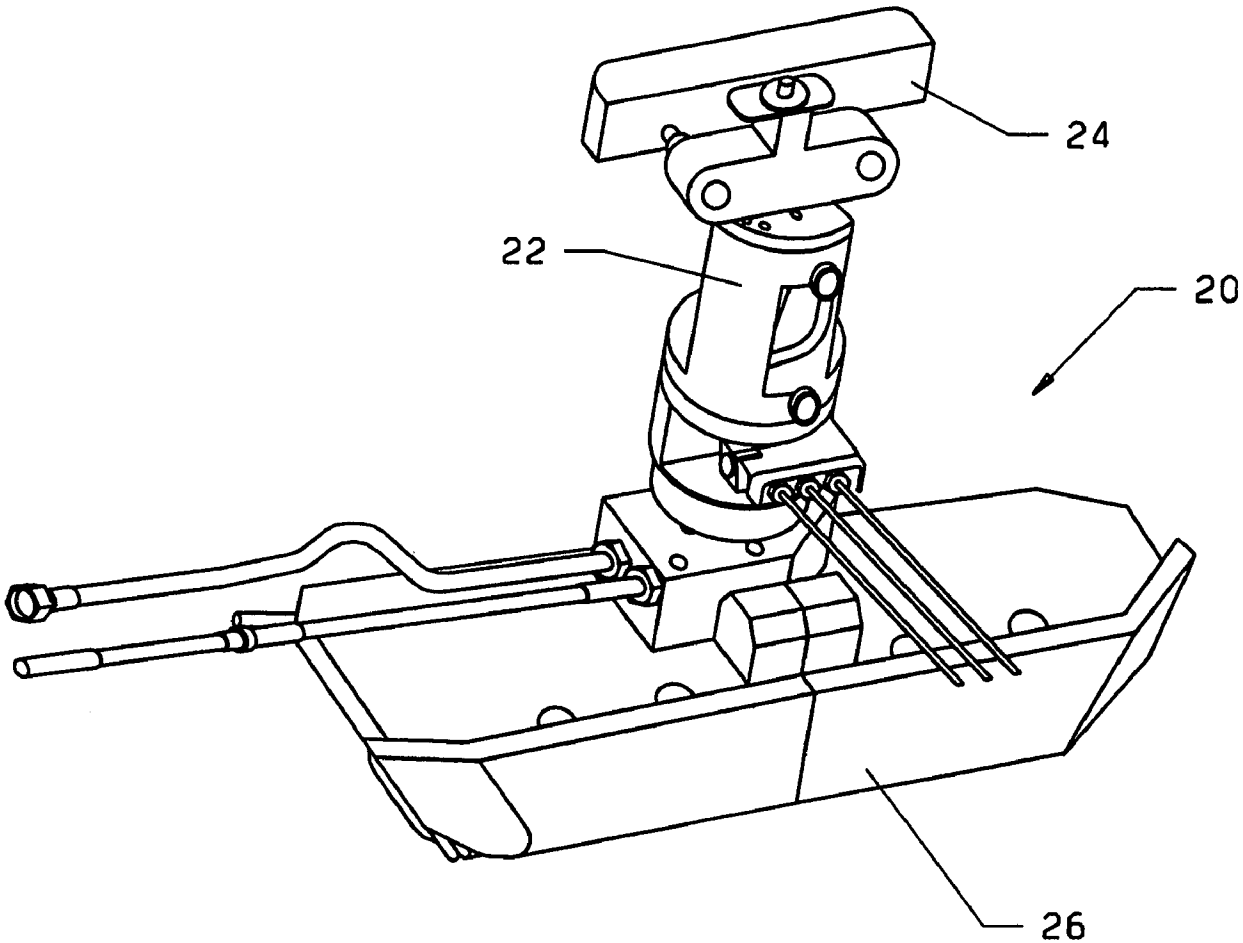
FIG. 2 is an isometric view of the sludge cleaning system of the present invention mounted on a locomotion device using a rubber tread drive.

As seen in FIGS. 2-3 a reaction force skid assembly (24) is attached to the top of the turret assembly (22) by pushing it over a peg (52). The skid assembly contacts the interior shell (18) of the vessel to stabilize the turret (22) against the water jet reaction force (28). To elaborate, the skid is there to keep the reaction force of the line pressure nozzles from pushing the turret (22) over backwards. This skid (24) may be replaced with electromagnets actuated to act as a brake that holds the assembly (20) in place while the jets are at a high pressure.

Figure 10:
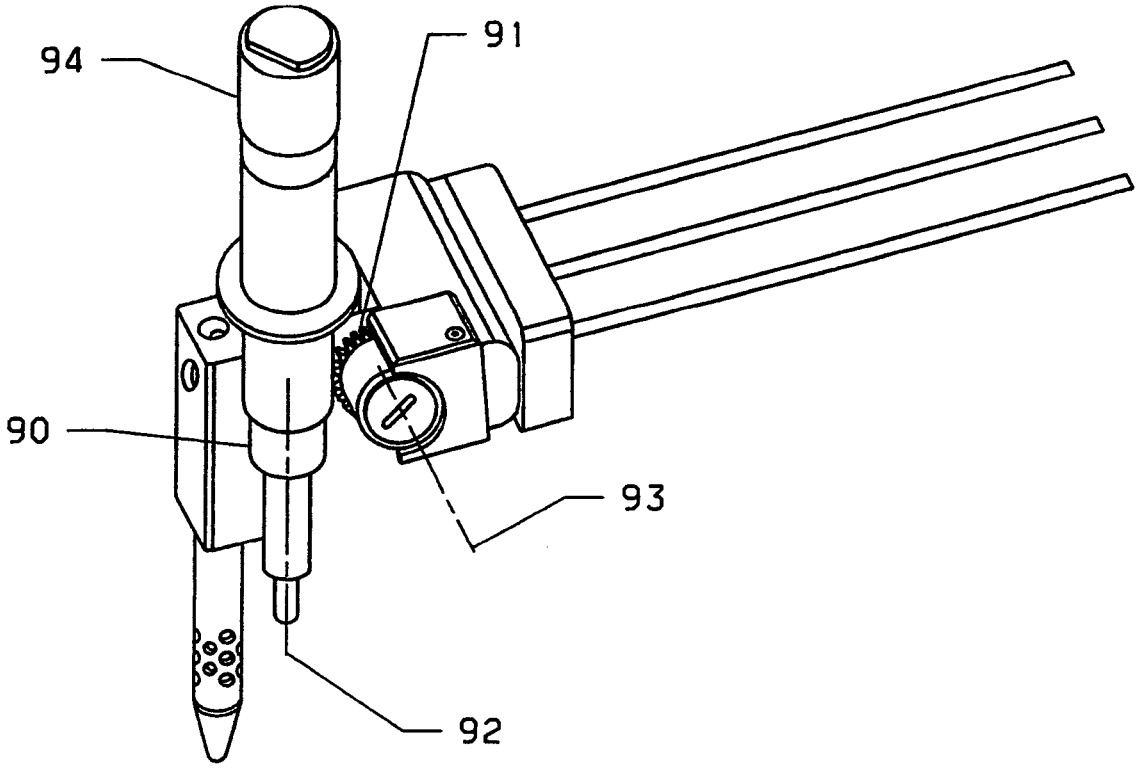
FIG. 10 is an isometric view of the portion of the turret responsible for the nozzle location.

As seen in FIG. 10, the cleaning device, or turret (22) has a two axis positioning system capable of rotating the nozzles about a horizontal axis (93) using a worm (90) and worm gear (91) while also rotating the nozzles about a vertical axis a full 360 degrees. To elaborate (see FIG. 3), the bottom part (54) of the turret (22) stays locked into the swivel/locking mechanism (36) via the two conical pins (40, 42). The upper part of the turret (56) which contains the nozzles (28) then can rotate about a vertical axis a full 360 degrees, if needed. This allows the turret (22) to view and/or spray water in the direction the crawler (26) is traveling, the direction the crawler (26) has just traveled from, or any direction into the tube bundle as needed. The nozzles (28) also rotate about a horizontal axis using the worm gear drive which allows the nozzles to be directed downward in front of the turret, and then slowly rocked upward until they are horizontal. As is best seen in FIG. 10, electric motor (94) rotates the worm (90) around a vertical axis (92). This motion rotates the worm gear (91) around a horizontal axis (93).

Rotation of the nozzles (28) about the vertical axis is possible because the central conical pin (40) acts as a high pressure swivel when it is inserted into the swivel/locking mechanism (36) on the crawler (26).

To insert the cleaning system (20) into the annulus (16) of a steam generator, the system is broken into the three main components shown in FIG. 3. The crawler (26) is inserted through the secondary side handhole (58) and placed in the annulus (16) directly below the handhole (58). The turret (22) is then inserted through the handhole (58) and the two pins (40, 42) are inserted into the corresponding holes in the swivel/locking mechanism (36). The skid assembly (24) is then inserted through the handhole (58) and placed on the post (52) located on the top of the turret (22).

The assembled system (20) is moved in the annulus (16) by actuating the electric motor drive powering the recirculating rubber treads (49) that are part of the crawler assembly (26).

Figure 5:
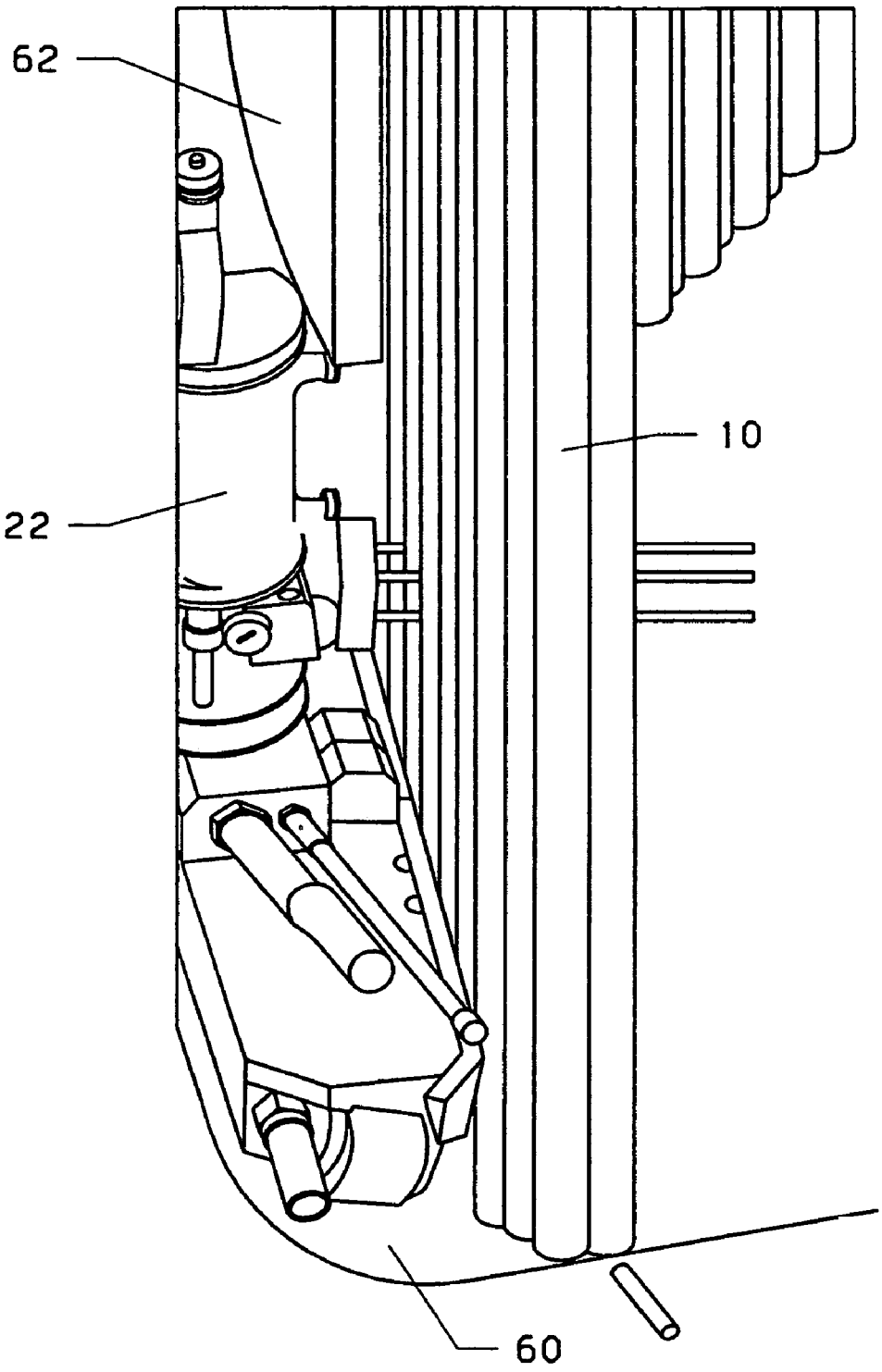
FIG. 5 shows a side view of the cleaning system of FIG. 2 mounted in the steam generator.
Figure 6:
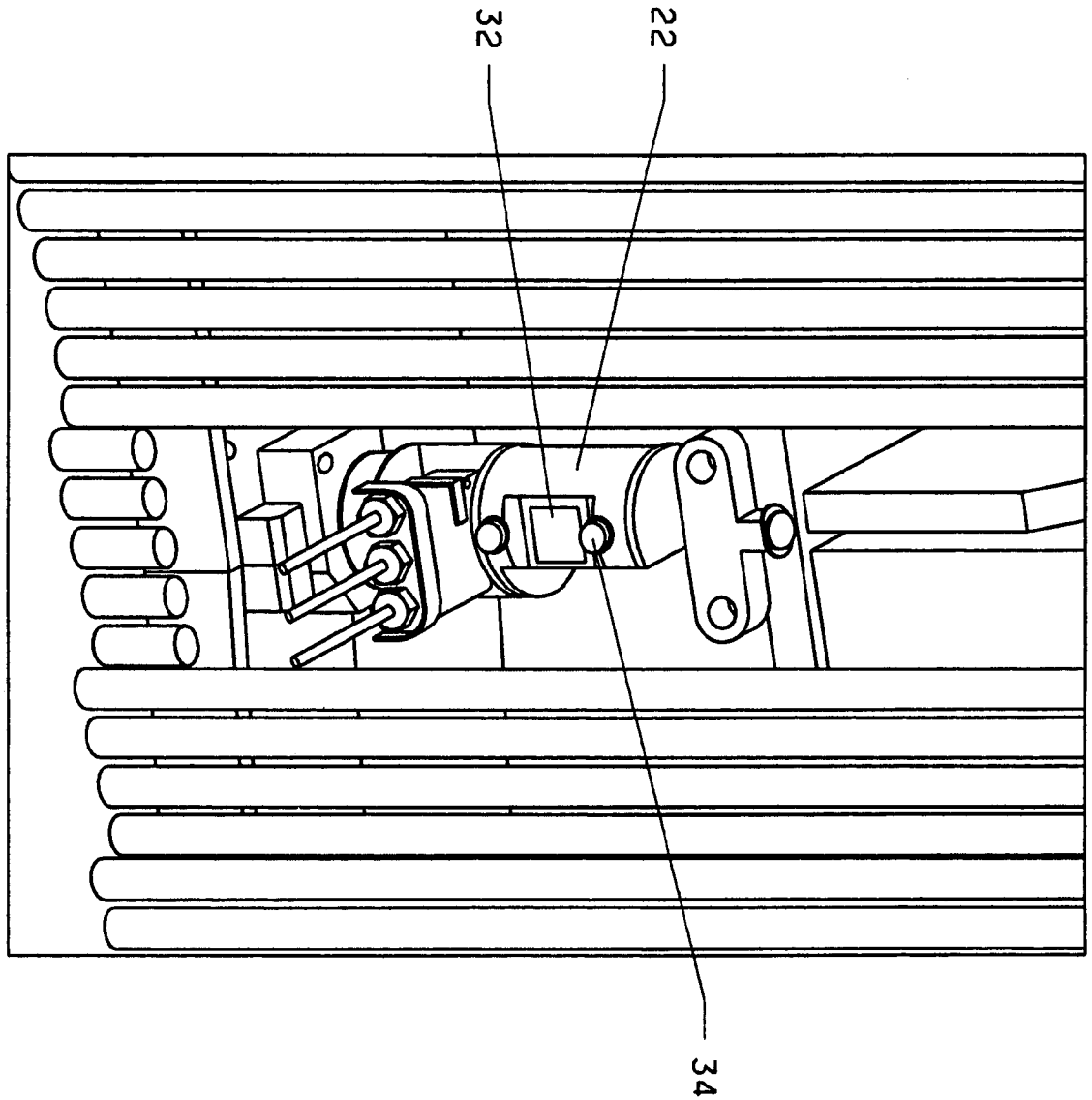
FIG. 6 shows a front view of the FIG. 5 mounted cleaning system.

To summarize, as best seen in FIGS. 5-6, the system turret (22) consists of multiple high pressure nozzles (28), an on board camera (32 and lighting system (34) and a two axis positioning system capable of rotating the nozzles (28) about a horizontal axis using a worm and worm gear while also rotating the nozzles about a vertical axis a full 360 degrees. This device when coupled to a delivery system, preferably the crawler (26) can travel around the entire vessel assembly (16) and direct the water jets into the tube bundle (10) at any angle about a vertical axis, and also can sweep the tube sheet (60) or tube support plate with the water jets by rotating them about a horizontal axis. The on board camera (32) and lighting system (34) can be used for visual inspection of the interior of the vessel, or for aligning the water jets between the heat exchanger tubes (12).

Figure 7:
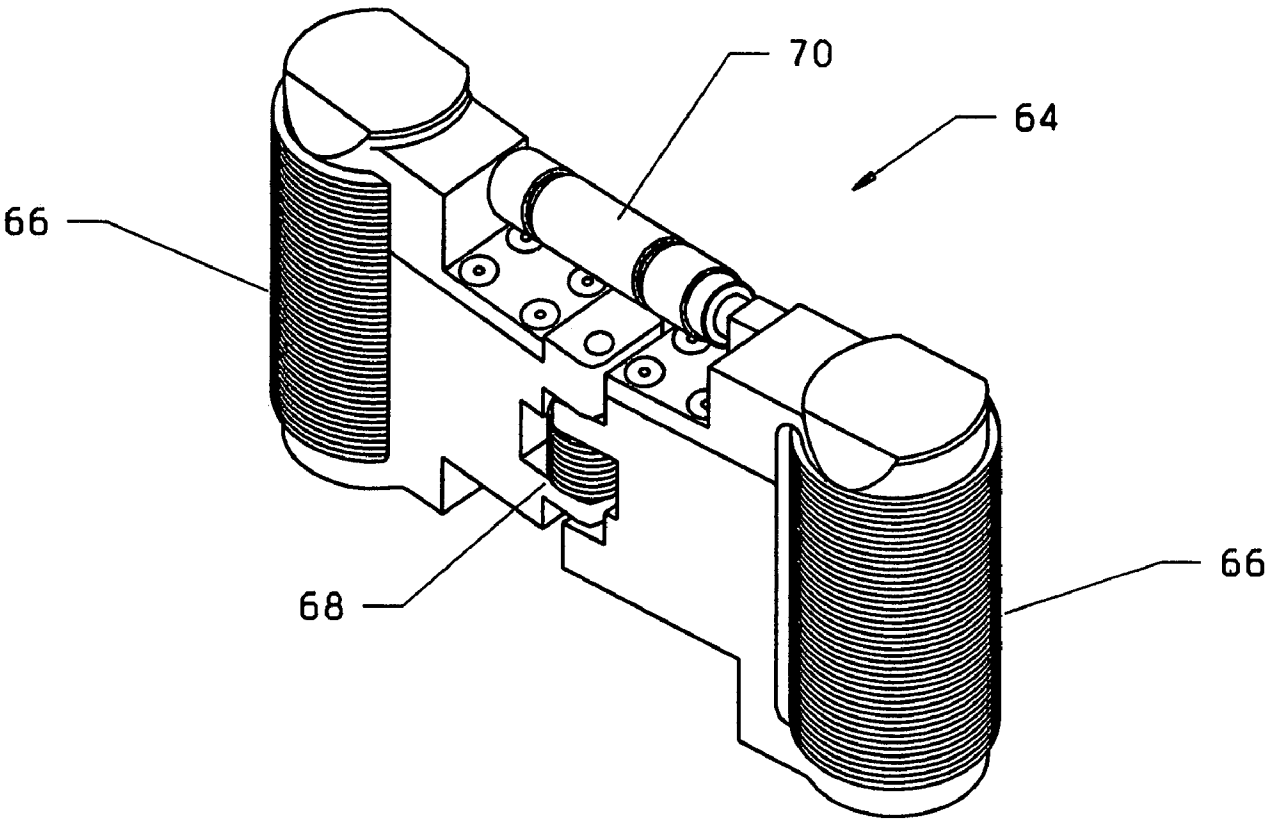
FIG. 7 is an isometric view of an alternate wedge track locomotion drive.
Figure 8:
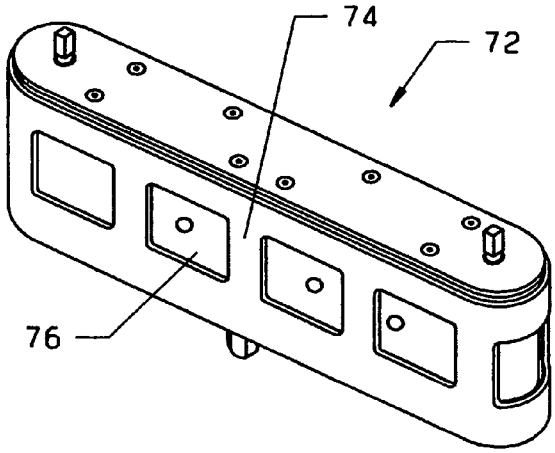
FIG. 8 is an isometric view of an alternate suction track locomotion drive.
Figure 9:
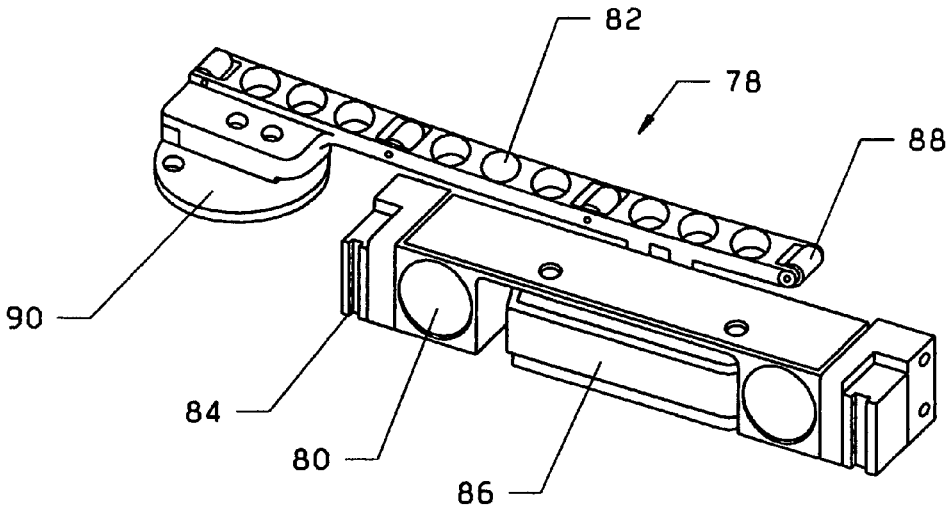
FIG. 9 is an isometric view of an alternate magnetic track locomotion drive.

Turning now to FIG. 7-9, it will be seen that the turret (22) may be propelled within the annulus (16) by other types of locomotion devices. FIG. 7 shows a wedge track device (64) consisting of outer rollers (66) an inner roller/pivot (68) and a fluid cylinder (70).

The multiple rollers (66) are wedged between two concentric cylinders, two curved surfaces, or two flat surfaces. Friction to drive the device is created by on board fluid or pneumatic cylinders that pivot the device about a center roller, thus forcing the outer rollers against one surface and the inner roller against the other surface. The motor is mounted concentric to one of the outer rollers. The track is a platform to deliver the cleaning device, or inspection, retrieval, and repair tooling.

The swivel/locking mechanism (36) is located underneath the wedge track device (64) vertically below the inner roller/pivot (68). The wedge track device (64) is inserted in through the handhole (58) and momentarily held in position between two curved surfaces or two flat surfaces until the fluid cylinders (70) are activated thus holding the device (64) in place. The system turret (22) is then locked into the swivel/locking mechanism (36) in the same manner as with the crawler assembly (26). The skid assembly (24) is then inserted through the handhole (58) located on the top of the turret (22). The wedge track device (64) is then driven to any desired location axially or radially between the surfaces which the device (64) was locked in position.

FIG. 8 shows the suction track drive (72) consisting of the cogged belt (74) and the belt cutouts (76). This device (72) may have many different shapes depending on the surfaces that it will adhere to. The belt does not have to be cogged. The material on the exterior of the belt may be flat or a ribbed geometry to improve its sealing characteristics. More than one electric motor may be used to drive the track (74). Encoder or resolver feedback may be used to monitor the track's position. This device is not limited for use in the lower tubesheets. This device (72) propelled by a motor that adheres itself to a surface using vacuum. The vacuum can be generated by an on board vacuum generator, or a remote vacuum generator. The device uses a cogged belt with a resilient exterior surface to conform and seal to irregular surfaces. A plurality of cutouts in the center of the belt act as individual suction cups. The track is a platform to deliver the cleaning device, or inspection, retrieval, and repair tooling. The track is capable of adhering to horizontal (both on top and underneath), angled and vertical surfaces.

The swivel locking mechanism (36) is located underneath the suction track drive (72) vertically below the centerline. The suction track drive (72) is inserted in through the handhole (58) and is momentarily held against the steam generator shell or shroud until the vacuum adheres the device to the surface. The system turret (22) is then locked into the swivel/locking mechanism (36) in the same manner as with the crawler assembly (26). The skid assembly (24) is then inserted through the handhole (58) placed on the post (52) located on top of the turret (22). The suction track drive (72) is then driven to any desired location radially along the steam generator shell or shroud or along any other curved, flat or angled surface.

FIG. 9 shows a magnetic track drive (78) consisting of a permanent magnets (80, 82), electromagnets (84), track with treads (86) and rollers (88).

This device (78) may be configured in different geometries depending on the surface on which it adheres. It may be propelled by wheels instead of tracks and treads, or with a magnetic track. Encoder or resolver feedback may be used to monitor the track's position.

The device (78) is propelled by a single or multiple sealed tracks using re-circulating rubber tread. The device uses either permanent magnets or electromagnets to maintain contact underneath a metal surface, such as the bottom of a steam generator shroud. The device uses either permanent magnets or electromagnets to maintain pressure on the track(s) creating the friction force required to propel the device. The device uses rollers or spacers to maintain the correct distance between the magnets and the metal surfaces. The track is a platform to deliver the cleaning device, or inspection, retrieval, and repair tooling as follows The swivel locking mechanism (36) is located on the magnetic track drive (78) horizontally at the end of the magnetic roller bar (90). The magnetic track drive (78) is inserted in through the handhole 458) and is magnetically coupled to the steam generator shell and or shroud. The system turret (22) is then locked into the swivel/locking mechanism (36) in the same manner as with the crawler assembly (26). The skid assembly (24) is then inserted through the handhole (58) placed on the post (52) located on the top of the turret (22). The magnetic track drive (78) is then driven to any desired location radially along the steam generator shell or shroud or along any other curved, flat or angled surface.

It will be understood that certain obvious details and modifications have been deleted herein for the sake of conciseness and readability but are properly included within the scope of the following claims.

We claim:

1. A system for delivering tooling around the annulus of a steam generator comprising:

a tooling device capable of performing a particular steam generator maintenance function;

a locomotion system having said tooling device mounted thereto and being located in the annulus of the stem generator to be capable of moving therealong to perform said particular steam generator maintenance function;

wherein said tooling device is a turret cleaning device having multiple high pressure water nozzles able to rotate 180 degrees about a horizontal axis enabling it to clean multiple steam generator tube lanes simultaneously;

wherein said turret also rotates 360 degrees about a vertical axis allowing it to clean the front and back of the annulus floor and tube sheet of the steam generator; and wherein said locomotion device is an electric motor driven crawler device propelled by two bottom mounted tracks using recirculating rubber treads and having soft plastic bumpers mounted to the side thereof to prevent contact of any metal components of said crawler from contacting steam generator tubing.

2. A system as set forth in claim 1 wherein said turret has a skid assembly mounted to the top thereof to make contact with the interior shell of the steam generator during cleaning operations to stablilize said turret against the high pressure water jet reaction force preventing said turret from being pushed backwards.

3. A system as set forth in claim 1 wherein said locomotion device is a wedge track device comprising outer rollers, an inner roller/pivot and a fluid cylinder for powering said wedge drive.

4. A system as set forth in claim 1 wherein said locomotion device is a suction track drive having a cogged belt and belt cutouts.

5. A system as set forth in claim 1 wherein said locomotion device is a magnetic tract drive comprising;

a sealed track having recirculating rubber treads;

a magnet to maintain contact of said treads with the metal surface of the annulus and maintain pressure on said treads thereby; and rollers to maintain a desired distance between said magnet and the metal surface.

6. A system as set forth in claim 1 wherein said magnet is a permanent magnet.

7. A system as set forth in claim 1 wherein said magnet is an electromagnet.

* * * * *